US008701237B2

(12) United States Patent
Brosche

(10) Patent No.: US 8,701,237 B2
(45) Date of Patent: Apr. 22, 2014

(54) CAULK FINGER WIPING APPARATUS AND METHODS OF MAKING AND USING THE SAME

(76) Inventor: David M. Brosche, Cartersville, GA (US)

( * ) Notice: Subject to any disclaimer, the term of this patent is extended or adjusted under 35 U.S.C. 154(b) by 223 days.

(21) Appl. No.: 13/306,293

(22) Filed: Nov. 29, 2011

(65) Prior Publication Data

US 2013/0134182 A1 May 30, 2013

(51) Int. Cl.
*A46B 15/00* (2006.01)
*B67D 1/07* (2006.01)

(52) U.S. Cl.
USPC ..... 15/105; 15/236.01; 222/192

(58) Field of Classification Search
USPC ..... 222/192, 324, 325, 326, 327; 15/236.01, 105, 105.5, 256.5, 236.03, 15/246, 257.05, 260, 236.07, 236.05, 118; 425/458
See application file for complete search history.

(56) References Cited

U.S. PATENT DOCUMENTS 6,067,683 A * 5/2000 Reeves ..... 15/105

* cited by examiner

*Primary Examiner* — Kevin P Shaver
*Assistant Examiner* — Stephanie E Williams
(74) *Attorney, Agent, or Firm* — Withers & Keys, LLC

(57) ABSTRACT

An apparatus for removing caulk from a user's finger(s) and tool(s) (i.e., a caulk finger wiping apparatus) is disclosed. The apparatus is used in combination with a disposable tube-style caulk cartridge and in conjunction with any one of multiple styles of caulking guns. The apparatus includes an upper edge that may have finger receiving notches for removing caulk from a user's finger(s) and tool(s), and an apparatus component for collecting the removed caulk. Methods of making and using the apparatus for removing caulk from a user's finger(s) and tool(s) are also disclosed.

20 Claims, 8 Drawing Sheets

CAULK FINGER WIPING APPARATUS AND METHODS OF MAKING AND USING THE SAME

TECHNICAL FIELD

The present invention relates to caulk finger wiping apparatus, methods of making caulk finger wiping apparatus, and methods of using caulk finger wiping apparatus.

BACKGROUND

It is well known by those skilled in applying caulking that as it is applied, caulking has a tendency to assume an uneven configuration which has a rippling or puddling aspect. The caulking must be smoothed to eliminate the unevenness thereof and while tools exist for this purpose, the prevalent method of eliminating the unevenness of the caulking is for the user to run his/her finger(s) and/or smoothing tool(s) over the surface of the caulking to achieve the desired smoothing thereof. As a result of from this process, accumulated caulk adheres to the finger(s) and is typically removed from the finger(s) and/or tool(s) by wiping the accumulated caulk on a rag or random object often producing messy results. This is especially true if the user is working from a ladder as two hands are required to operate the caulking gun and often the user holds the gun in one hand while finger wiping the caulk with the other hand in case additional caulk is required. This makes it difficult to quickly locate and utilize a rag or other object to use to clean accumulated caulk from a finger or tool and return to smoothing additional caulk or other tasks.

Known caulk finger wiping apparatus, such as disclosed in U.S. Pat. No. 6,067,683, have a number of drawbacks. For example, known caulk finger wiping apparatus attach to a specific type of caulking gun and along a specific location of the specific type of caulking gun. Consequently, known caulk finger wiping apparatus are limited to use with a specific type of caulking gun, and a specific location along the caulking gun.

It would be advantageous for a caulk finger wiping apparatus to be removably attachable to and compatible with multiple styles and sizes of caulk cartridges for use in conjunction with multiple styles and sizes of caulking guns. Further, it would be advantageous for a caulk finger wiping apparatus that can be used in a plurality of positions, designated by a user, along a caulk cartridge, including a plurality of positions along the top or side of the caulk cartridge so as to allow the caulking gun with caulk finger wiping apparatus attached to the caulk cartridge to fit into confined spaces with the caulk finger wiping apparatus being accessible from both sides of the caulking gun when space permits.

Efforts continue in the development of caulk finger wiping apparatus that (1) provide one or more unique features and advantages over known caulk finger wiping apparatus, (2) are relatively easy to manufacture and use, (3) provide quick results for the user, and (4) are economical to make and use.

SUMMARY

The present invention continues the effort to develop caulk finger wiping apparatus that (1) provide one or more unique features and advantages over known caulk finger wiping apparatus, (2) are relatively easy to manufacture and use, (3) provide quick results for the user, and (4) are economical to make and use. The present invention is directed to caulk finger wiping apparatus as described and shown herein.

In accordance with the above, the present invention is directed to a caulk finger wiping apparatus that provide a simple, efficient, inexpensive, and disposable or reusable device for wiping and containing caulk from a user's finger(s) and/or tools, and more particularly to a caulk finger wiping apparatus that is removably attachable to a tube-style caulk cartridge for use in conjunction with multiple styles of caulking guns.

In one exemplary embodiment, the caulk finger wiping apparatus of the present invention comprises (I) a caulk cartridge contact member comprising a central region having a first outer edge, a second outer edge opposite the first outer edge, a concave lower surface extending between the first and second outer edges, and a convex upper surface opposite the concave lower surface; a first side wall extending upward from and along the first outer edge of the central region, the first side wall comprising at least one cut-out portion positioned along an upper edge of the first side wall, at least a portion of the upper edge of the first side wall being above the convex upper surface of the central region; and a second side wall extending upward from and along the second outer edge of the central region, at least a portion of an upper edge of the second side wall being above the convex upper surface of the central region; and (II) a connection member operatively adapted to position the caulk cartridge contact member along an outer surface of a caulk cartridge.

In some embodiments, the caulk finger wiping apparatus of the present invention comprises a connection member, wherein the connection member comprises a layer of adhesive operatively adapted to adhesively attach the caulk cartridge contact member along an outer surface of a caulk cartridge. In other embodiments, the caulk finger wiping apparatus of the present invention comprises a connection member, wherein the connection member comprises a mechanical fastener (e.g., corresponding male and female components, such as hook and loop material). In yet other embodiments, the caulk finger wiping apparatus of the present invention comprises a connection member, wherein the connection member comprises a circumferencing extension member integrally connected to the second side wall of the caulk cartridge contact member, the circumferencing extension member having a first connecting end extending along at least a portion of the second side wall, a second end opposite the first connecting end, and a curved section extending between the first connecting end and the second end, the curved section having a concave inner surface and a convex outer surface, and the curved section being sized to at least partially contact and extend along an outer surface of a caulk cartridge when positioned next to the outer surface of a caulk cartridge.

The present invention is further directed to methods of making a caulk finger wiping apparatus. In one exemplary embodiment, the method of making a caulk finger wiping apparatus comprises forming a caulk cartridge contact member comprising a central region having a first outer edge, a second outer edge opposite the first outer edge, a concave lower surface extending between the first and second outer edges, and a convex upper surface opposite the concave lower surface; a first side wall extending upward from and along the first outer edge of the central region, the first side wall comprising at least one cut-out portion positioned along an upper edge of the first side wall, at least a portion of the upper edge of the first side wall being above the convex upper surface of the central region; and a second side wall extending upward from and along the second outer edge of the central region, at least a portion of an upper edge of the second side wall being above the convex upper surface of the central region. The method of making a caulk finger wiping apparatus may further comprise one or more additional steps such as providing a connection member operatively adapted to position the caulk cartridge contact member along an outer surface of a caulk cartridge.

The present invention is even further directed to methods of using a caulk finger wiping apparatus. In one exemplary embodiment, the method of using a caulk finger wiping apparatus comprises attaching a caulk finger wiping apparatus to a caulk cartridge, wherein the caulk finger wiping apparatus comprises (I) a caulk cartridge contact member comprising a central region having a first outer edge, a second outer edge opposite the first outer edge, a concave lower surface extending between the first and second outer edges, and a convex upper surface opposite the concave lower surface; a first side wall extending upward from and along the first outer edge of the central region, the first side wall comprising at least one cut-out portion positioned along an upper edge of the first side wall, at least a portion of the upper edge of the first side wall being above the convex upper surface of the central region; and a second side wall extending upward from and along the second outer edge of the central region, at least a portion of an upper edge of the second side wall being above the convex upper surface of the central region; and (II) a connection member operatively adapted to position the caulk cartridge contact member along an outer surface of a caulk cartridge. The method of using a caulk finger wiping apparatus may further comprise one or more additional steps such as positioning the caulk finger wiping apparatus/caulk cartridge combination within a caulking gun.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

DETAILED DESCRIPTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to caulk finger wiping apparatus as described and shown herein. The present invention is further directed to methods of making caulk finger wiping apparatus. In addition, the present invention is directed to methods of using caulk finger wiping apparatus.

Figure 1A:
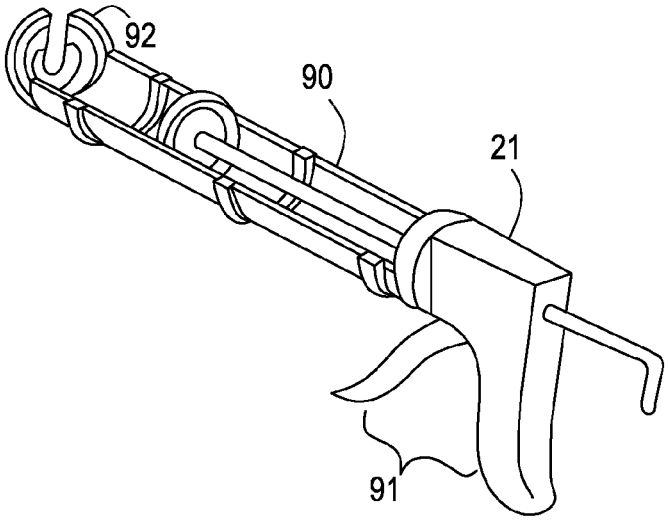
FIG. 1A (PRIOR ART)
FIGS. 1A-1C provide a perspective view of three conventional caulking guns of the prior art, namely, a conventional cradle-type caulking gun, a skeleton frame-type caulking gun, and a light-weight type caulking gun.
Figure 1B:
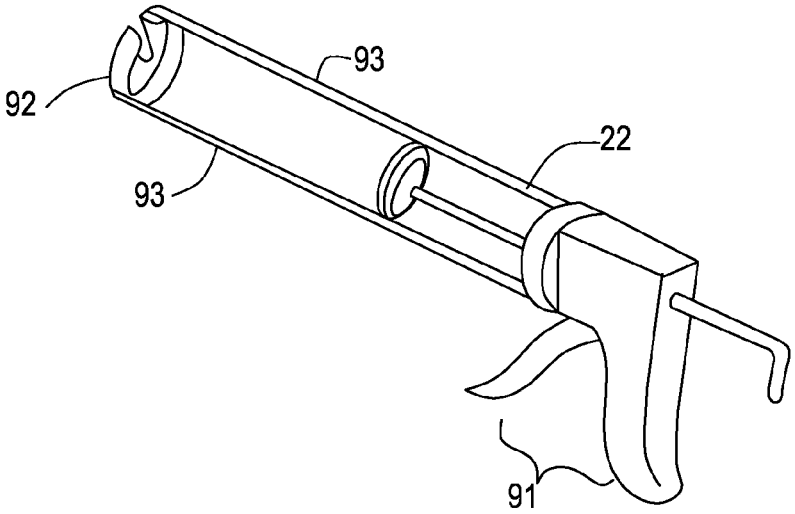
FIG. 1B (PRIOR ART)
Figure 1C:
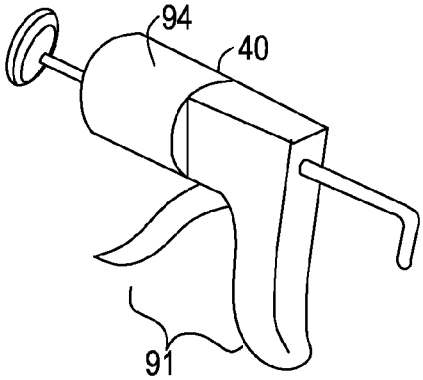
FIG. 1C (PRIOR ART)

The caulk finger wiping apparatus of the present invention may be used in combination with a conventional tube-like caulk cartridge (e.g., caulk cartridge 19 shown in FIGS. 3-4) and any one of the conventional caulking guns shown in FIGS. 1A-1C, namely, a conventional cradle-type caulking gun 21, a skeleton frame-type caulking gun 22, and a light-weight type caulking gun 40. As shown in FIG. 1A, conventional cradle-type caulking gun 21 is characterized by a cradle 90 into which a caulk cartridge (not shown) is positioned. Cradle 90 also connects a rear handle portion 91 of the gun to a forward support yoke 92. As shown in FIG. 1B, skeleton frame-type caulking gun 22 comprises two opposing frame supports 93 that connect rear handle portion 91 of the gun to forward support yoke 92. As shown in FIG. 1C, light-weight type caulking gun 40 comprises a short encased barrel 94 into which the end of a caulk cartridge (not shown) is received and secured, with no additional frame extending to the front of the caulk cartridge.

Figure 2:
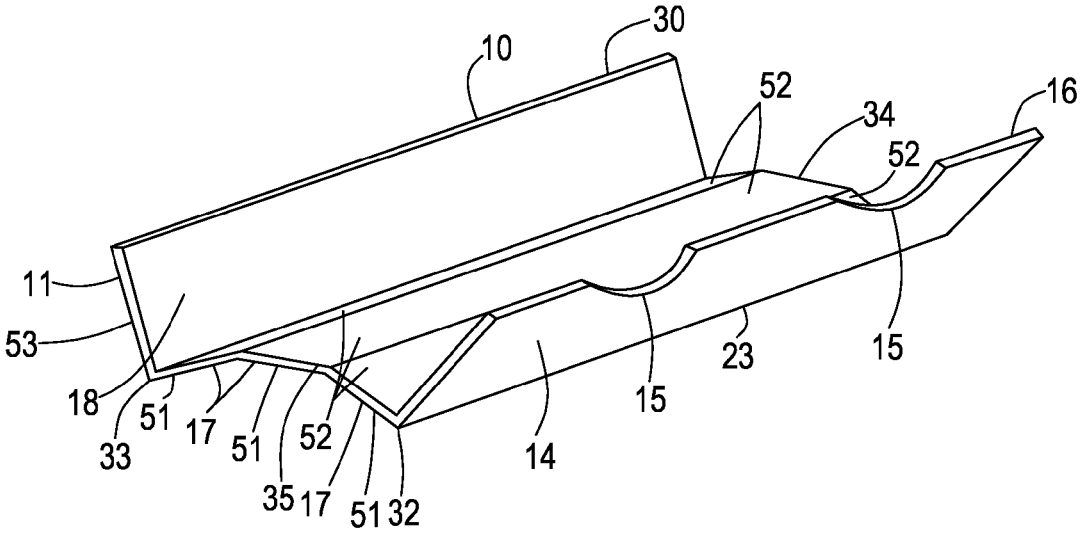
FIG. 2 provides a perspective view of an exemplary caulk finger cleaning apparatus of present invention.

An exemplary caulk finger cleaning apparatus of present invention is provided in FIG. 2. As shown in FIG. 2, exemplary caulk finger cleaning apparatus 10 comprises a caulk cartridge contact member 23 comprising a central region 17 having a first outer edge 32, a second outer edge 33 opposite the first outer edge 32, a concave lower surface 51 extending between the first and second outer edges 32 and 33, a convex upper surface 52 opposite the concave lower surface 51, and opposite end edges 34 and 35. Exemplary caulk cartridge contact member 23 further comprises a first side wall 14 extending upward from and along the first outer edge 32 of the central region 17, wherein the first side wall 14 optionally comprises at least one cut-out portion 15 positioned along an upper edge 16 of the first side wall 14, and at least a portion of the upper edge 16 of the first side wall 14 is above the convex upper surface 52 of the central region 17. Exemplary caulk cartridge contact member 23 also comprises a second side wall 18 extending upward from and along the second outer edge 33 of the central region 17, wherein at least a portion of an upper edge 30 of the second side wall 18 is above the convex upper surface 52 of the central region 17.

As discussed herein, the caulk finger cleaning apparatus of present invention further comprises a connection member operatively adapted to position the caulk cartridge contact member of the caulk finger cleaning apparatus along an outer surface of a caulk cartridge. In some embodiments, the caulk finger wiping apparatus of the present invention comprises a connection member, wherein the connection member comprises a layer of adhesive operatively adapted to adhesively attach the caulk cartridge contact member along an outer surface of a caulk cartridge. Such a connection member is shown in FIGS. 3-9.

Figure 3:
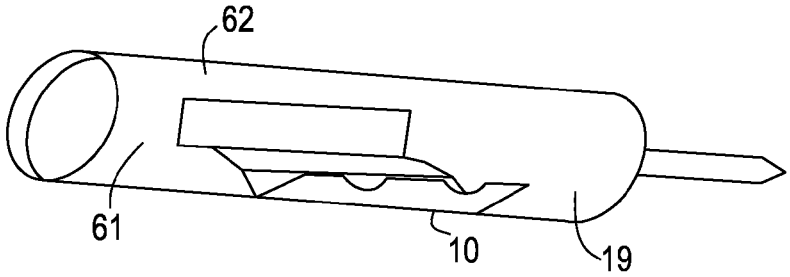
FIG. 3 provides a perspective view of an exemplary caulk finger cleaning apparatus of present invention adhesively attached to an outer side surface of a cartridge of caulk.
Figure 4:
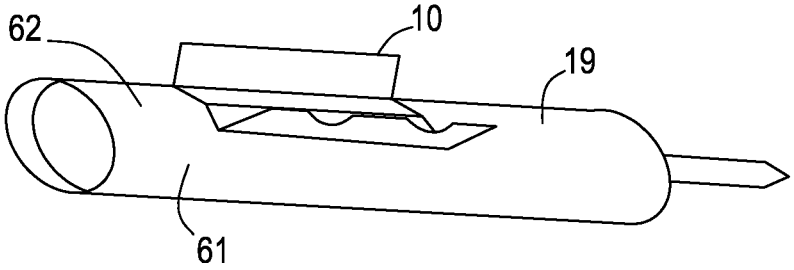
FIG. 4 provides a perspective view of an exemplary caulk finger cleaning apparatus of present invention adhesively attached to an outer top surface of a cartridge of caulk.

As shown in FIG. 3, exemplary caulk finger cleaning apparatus 10 may be adhesively attached to an outer side surface 61 of a tubular cartridge of caulk 19. Alternatively, as shown in FIG. 4, exemplary caulk finger cleaning apparatus 10 may be adhesively attached to an outer top surface 62 of caulk cartridge 19.

Figure 5:
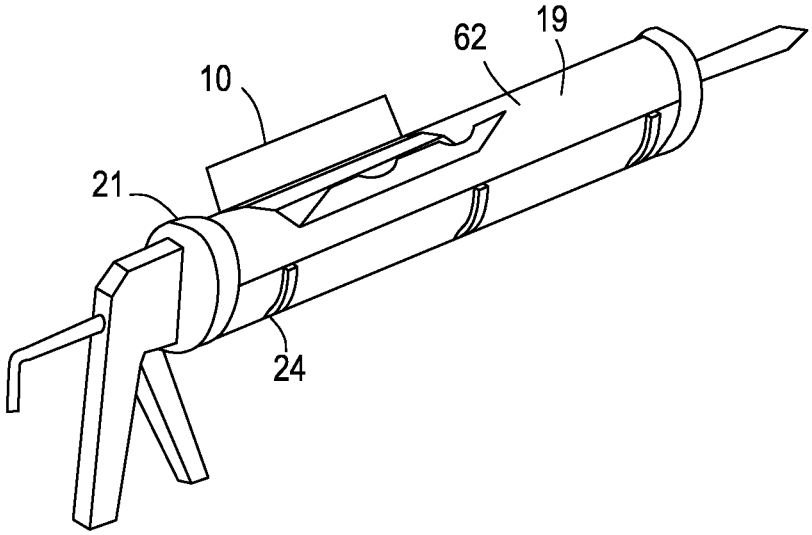
FIG. 5 provides a perspective view of the exemplary caulk finger cleaning apparatus of present invention adhesively attached to the outer top surface of a caulk cartridge as shown in FIG. 4 mounted in the conventional cradle-type caulking gun shown in FIG. 1A.
Figure 6:
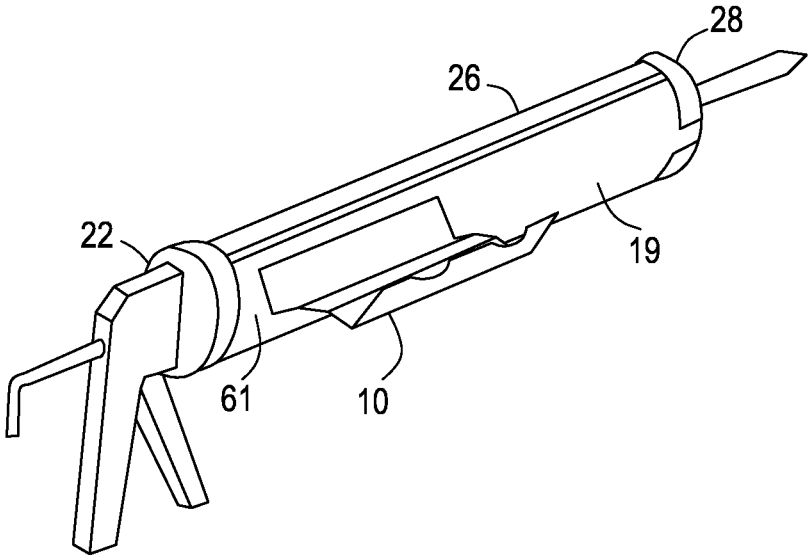
FIG. 6 provides a perspective view of the exemplary caulk finger cleaning apparatus of present invention adhesively attached to the outer side surface of a caulk cartridge as shown in FIG. 3 mounted in the skeleton frame-type caulking gun shown in FIG. 1B.
Figure 7:
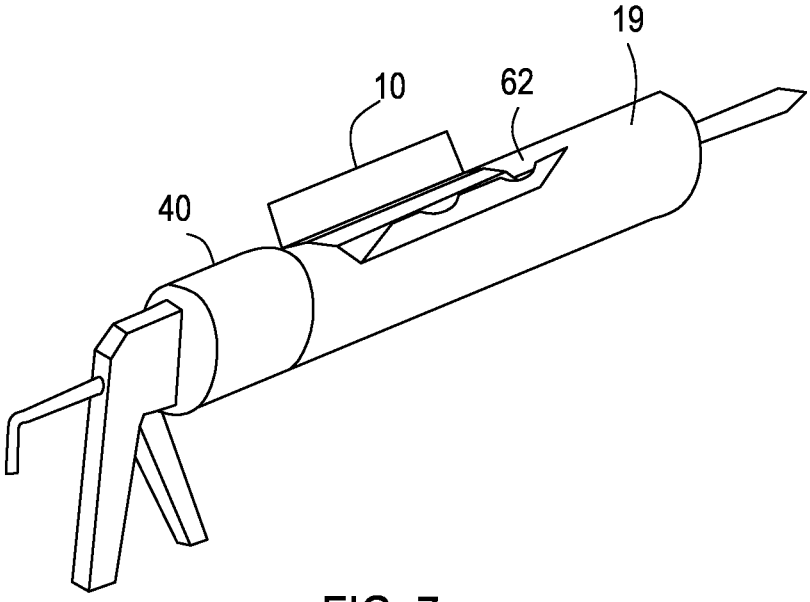
FIG. 7 provides a perspective view of the exemplary caulk finger cleaning apparatus of present invention adhesively attached to the outer top surface of a caulk cartridge as shown in FIG. 4 mounted in the light-weight style caulking gun shown in FIG. 1C.

As further shown in FIG. 5, exemplary caulk finger cleaning apparatus 10 may be adhesively attached to the outer top surface 62 of caulk cartridge 19 and mounted in conventional cradle-type caulking gun 21. Alternatively, as shown in FIG. 6, exemplary caulk finger cleaning apparatus 10 may be adhesively attached to outer side surface 61 of caulk cartridge 19 and mounted in skeleton frame-type caulking gun 22. In addition, as shown in FIG. 7, exemplary caulk finger cleaning apparatus 10 may be adhesively attached to outer top surface 62 of caulk cartridge 19 and mounted in light-weight style caulking gun 40.

Figure 8:
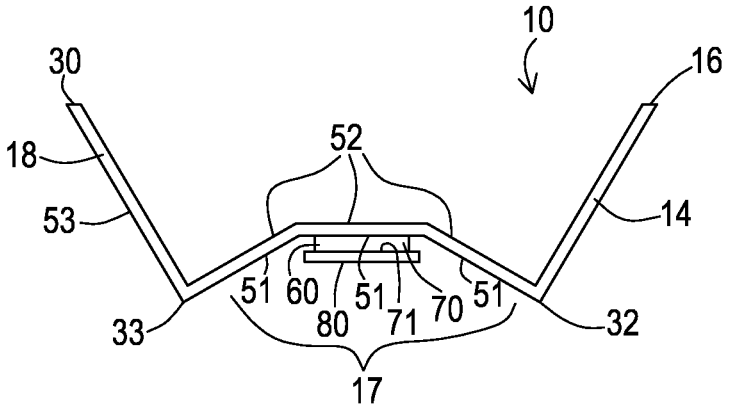
FIG. 8 provides a frontal view of the exemplary caulk finger cleaning apparatus of the present invention shown in FIG. 2.

As shown in FIGS. 2-7, caulk finger cleaning apparatus of the present invention may comprise a connection member that adhesively attaches to an outer surface of a caulk cartridge. FIG. 8 provides a frontal view of exemplary caulk finger cleaning apparatus 10 shown in FIG. 2, and indicates possible positions of such a connection member.

As shown in FIG. 8, exemplary caulk finger cleaning apparatus 10 comprises a connection member 60 in the form a layer of adhesive 70. Layer of adhesive 70 is operatively adapted to adhesively attach caulk cartridge contact member 23 along an outer surface (e.g., outer side surface 61 or top side surface 62) of caulk cartridge 19. In some embodiments, layer of adhesive 70 may comprise a piece of double-sided adhesive tape. In this embodiment, connection member 60 may further comprise a release liner 80 positioned over an outer adhesive surface 71 of double-sided adhesive tape 70.

Referencing FIGS. 3-4 and 8, it should be noted that connection member 60, in the form of an adhesive layer 70, may be positioned along one or more locations of caulk cartridge contact member 23. In some embodiments, as shown in FIG. 3, connection member 60, in the form of an adhesive layer 70, may be positioned along a lower surface 53 of second side wall 18 of caulk cartridge contact member 23. In other embodiments, as shown in FIG. 4, connection member 60, in the form of an adhesive layer 70, may be positioned along concave lower surface 51 of caulk cartridge contact member 23. In yet other embodiments, (not shown), multiple connection members 60, in the form of multiple adhesive layers 70, may be positioned along both (i) lower surface 53 of second side wall 18 and (ii) concave lower surface 51 of caulk cartridge contact member 23.

It should be noted that although connection member 60 is described as an adhesive layer 70, connection member 60 may comprise any material that enables connection of caulk cartridge contact member 23 to an outer surface (e.g., outer side surface 61 or top side surface 62) of caulk cartridge 19. In alternative embodiments, connection member 60 may comprise a mechanical fastener (e.g., hook and loop type materials); a male or female type fastener with one being positioned along caulk cartridge contact member 23 and the other being positioned along an outer surface of caulk cartridge 19; wire or string (e.g., extending around caulk cartridge 19 and through slits or holes within caulk cartridge contact member 23; etc.

It should be further noted that, in some embodiments, concave lower surface 51 of caulk cartridge contact member 23 may comprise one continuous surface forming an arc of curvature. However, in other embodiments, such as shown in FIG. 8, concave lower surface 51 of caulk cartridge contact member 23 may comprise two or more connected lower surface portions (i.e., FIG. 8 shows three surface portions forming concave lower surface 51) that together form a lower surface having a concave configuration (and a convex upper surface 52 of caulk cartridge contact member 23).

Figure 9:
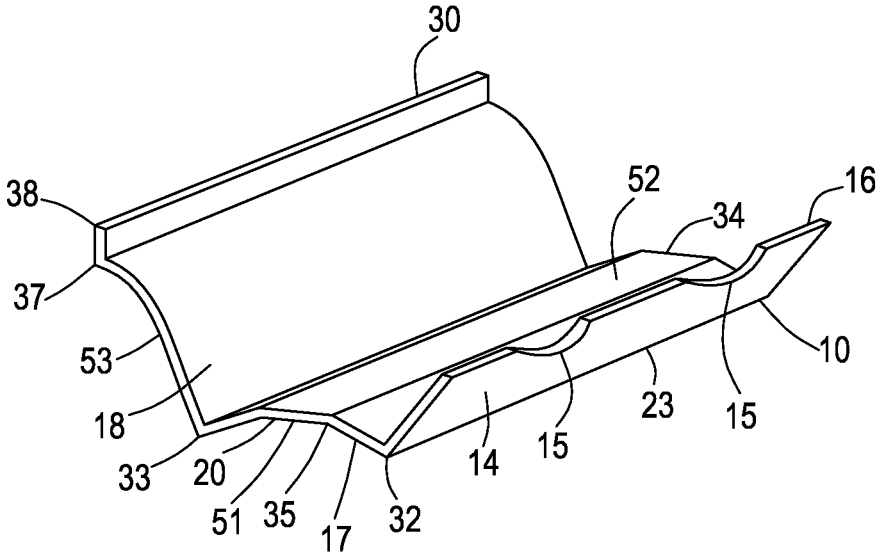
FIG. 9 provides a perspective view of another exemplary caulk finger cleaning apparatus of present invention.

As shown in FIG. 9, in some embodiments, exemplary caulk finger cleaning apparatus 10 may comprise caulk cartridge contact member 23, wherein caulk cartridge contact member 23 further comprises a vertical element 38 extending upward from an intermediate edge 37 of second side wall. Vertical element 38 provides a stop for caulk finger wiping apparatus 10 when attached to a caulk cartridge (e.g., caulk cartridge 19) positioned within a caulk gun (e.g., when positioned within skeleton-frame type caulking gun 22, i.e., vertical stop 38 prevents the caulk cartridge with caulk finger wiping apparatus 10 attached thereto from rotating within skeleton-frame type caulking gun 22).

Although not illustrated to any great degree in FIG. 9 (or in FIGS. 2 and 8), it should be understood that second side wall 18 extending upward from and along second outer edge 33 of central region 17 of caulk cartridge contact member 23 may have some curvature therein. Typically, when present, second side wall 18 will have a degree of slant and/or curvature so as to increase surface contact with a tubular caulk cartridge (e.g., caulk cartridge 19 shown in FIGS. 3-4). In other words, second side wall 18 may have a slanted surface that matches or complements an outer surface of caulk cartridge 19. In other embodiments, lower surface 53 of second side wall 18 may have a concave configuration similar to concave lower surface 51.

Figure 10:
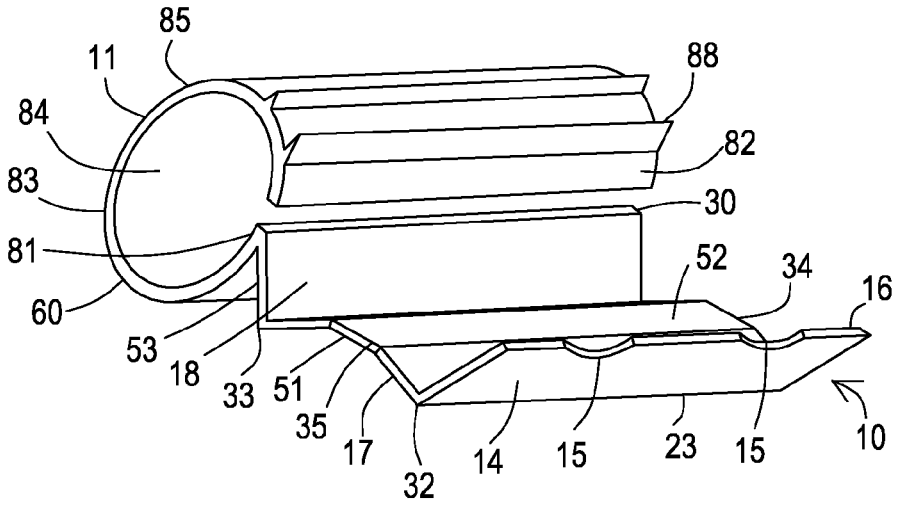
FIG. 10 provides a perspective view of another exemplary caulk finger cleaning apparatus of present invention illustrating a caulk cartridge circumferencing component of the exemplary caulk finger cleaning apparatus that surrounds a caulk cartridge.

In some embodiments of the present invention, exemplary caulk finger cleaning apparatus 10 further comprises a caulk cartridge circumferencing component (also referred to herein as "a circumferencing extension member of caulk cartridge contact member 23"). FIG. 10 provides a perspective view of exemplary caulk finger cleaning apparatus 10 with a caulk cartridge circumferencing component 11 that at least partially surrounds a caulk cartridge when placed thereon (see, for example, FIG. 11).

As shown in FIG. 10, exemplary caulk finger wiping apparatus 10 comprises connection member 60 in the form of a circumferencing extension member 11 integrally connected to second side wall 18. Circumferencing extension member 11 has a first connecting end 81 extending along at least a portion of second side wall 18, a second end 82 opposite first connecting end 81, and a curved section 83 extending between first connecting end 81 and second end 82, wherein curved section 83 has a concave inner surface 84 and a convex outer surface 85. Curved section 83 is sized to at least partially contact and extend along an outer surface of a caulk cartridge (see, for example, outer surface 63 of caulk cartridge 19 shown in FIG. 11) when positioned next to the outer surface of a caulk cartridge. In desired embodiment, circumferencing extension member 11 is integrally connected to second side wall 18 along upper edge 30 of second side wall 18.

Figure 11:
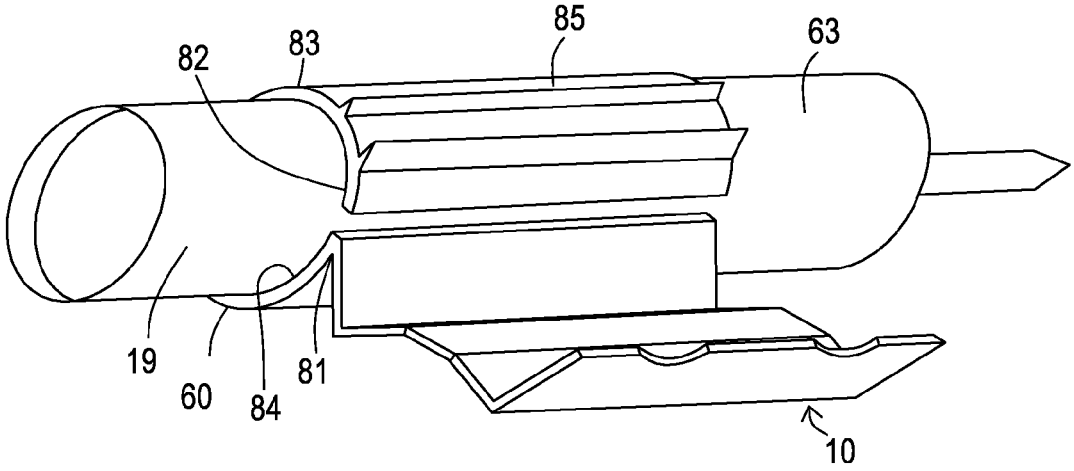
FIG. 11 provides a perspective view of the exemplary caulk finger cleaning apparatus shown in FIG. 10 with the caulk cartridge circumferencing component attached to a caulk cartridge.
Figure 12:
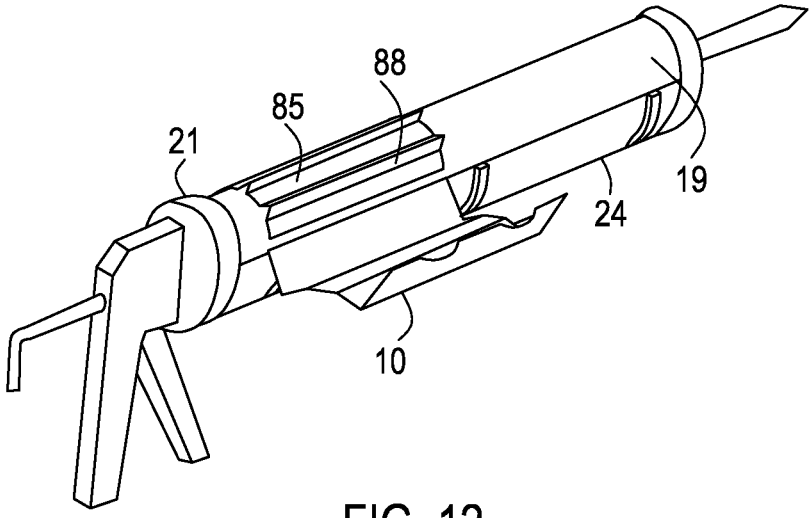
FIG. 12 provides a perspective view of the exemplary caulk finger cleaning apparatus/caulk cartridge combination shown in FIG. 11 mounted in the conventional cradle-type caulking gun shown in FIG. 1A.
Figure 13:
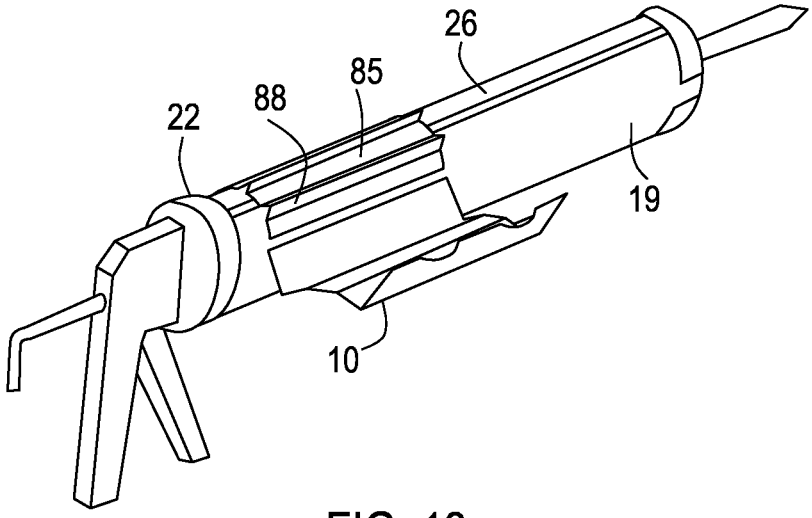
FIG. 13 provides a perspective view of the exemplary caulk finger cleaning apparatus/caulk cartridge combination shown in FIG. 11 mounted in the skeleton-frame type caulking gun shown in FIG. 1B.
Figure 14:
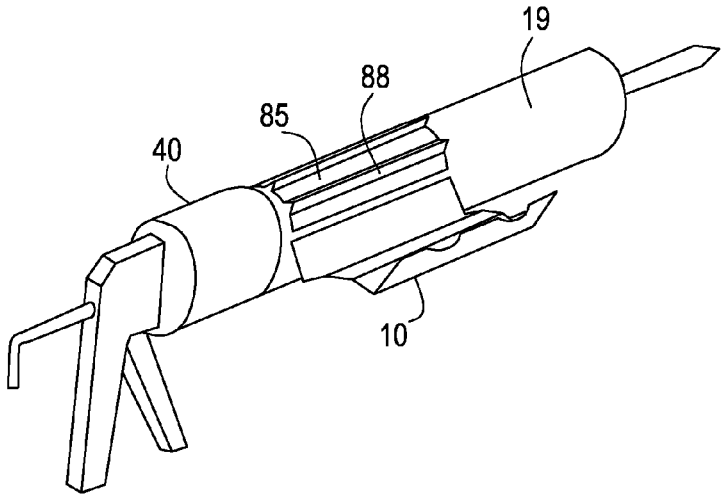
FIG. 14 provides a perspective view of the exemplary caulk finger cleaning apparatus/caulk cartridge combination shown in FIG. 11 mounted in the light-weight type caulking gun shown in FIG. 1C.

FIG. 11 provides a perspective view of exemplary caulk finger cleaning apparatus 10 shown in FIG. 10 with the caulk cartridge circumferencing component exemplary caulk finger cleaning apparatus 10 (i.e., circumferencing extension member 11) attached to a caulk cartridge 19. FIG. 12 provides a perspective view of exemplary caulk finger cleaning apparatus 10/caulk cartridge 19 combination shown in FIG. 11 mounted in the conventional cradle-type caulking gun 21 shown in FIG. 1A. Further, FIG. 13 provides a perspective view of exemplary caulk finger cleaning apparatus 10/caulk cartridge 19 combination shown in FIG. 11 mounted in the skeleton-frame type caulking gun 22 shown in FIG. 1B. In addition, FIG. 14 provides a perspective view of exemplary caulk finger cleaning apparatus 10/caulk cartridge 19 combination shown in FIG. 11 mounted in the light-weight type caulking gun 40 shown in FIG. 1C.

Figure 15:
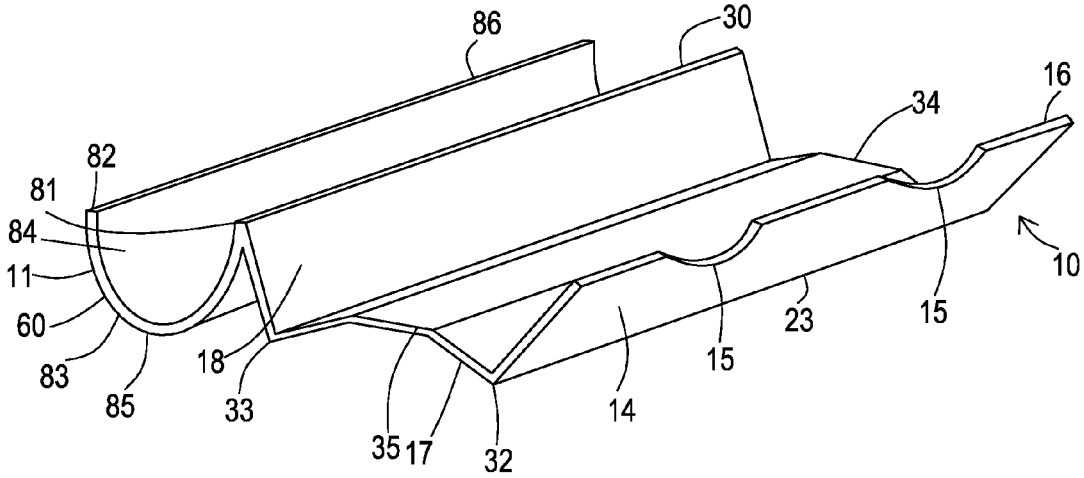
FIG. 15 provides a perspective view of another exemplary caulk finger cleaning apparatus of present invention illustrating a partially caulk cartridge circumferencing component that partially surrounds a caulk cartridge.

FIG. 15 provides a perspective view of another exemplary caulk finger cleaning apparatus 10 of present invention illustrating a caulk cartridge circumferencing component 11 that partially surrounds caulk cartridge 19 (as opposed to exemplary caulk finger cleaning apparatus 10 in FIG. 10-14, which almost completely surrounds caulk cartridge 19). As shown in FIG. 15, exemplary caulk finger wiping apparatus 10 comprises connection member 60 in the form of a circumferencing extension member 11 integrally connected to second side wall 18, wherein circumferencing extension member 11 has a first connecting end 81 extending along at least a portion of second side wall 18, a second end 82 opposite first connecting end 81, and a curved section 83 extending between first connecting end 81 and second end 82. In this embodiment, curved section 83 (*i*) has a concave inner surface 84 and a convex outer surface 85, and (*ii*) is sized to partially contact and extend along an outer surface of a caulk cartridge (see, for example, outer surface 63 of caulk cartridge 19 shown in FIG. 11) when positioned next to the outer surface of a caulk cartridge.

Desirably, circumferencing extension member 11 is integrally connected to second side wall 18 along upper edge 30 of second side wall 18. Further, as shown in FIGS. 10-15, circumferencing extension members of caulk finger cleaning apparatus of the present invention (e.g., circumferencing extension members 11) may have varying arcs of curvature along concave inner surface 84. In some embodiments, circumferencing extension member 11 typically has an arc of curvature of greater than about 90° and less than about 270° (as in FIG. 15). In one desired embodiment, circumferencing extension member 11 has an arc of curvature of about 180° (as in FIG. 15). In other embodiments, circumferencing extension member 11 has an arc of curvature of greater than about 270° up to about 360° (as in FIGS. 10-14).

As shown in FIGS. 10-14, circumferencing extension members 11 may further comprise one or more vertical elements 88 extending outward from convex outer surface 85. As shown in FIG. 13, vertical element 88 may be used to provide a stop for caulk finger wiping apparatus 10 when circumferencing extension member 11 of caulk finger wiping apparatus 10 is positioned along a caulk cartridge 19 positioned within a caulk gun. See, for example, caulk finger wiping apparatus 10 attached to caulk cartridge 19 positioned within skeleton frame-type caulking gun 22 in FIG. 13.

The present invention is further directed to any of the herein-described caulk finger wiping apparatus (e.g., caulk finger wiping apparatus 10) in combination with a caulk cartridge (e.g., caulk cartridge 19). The caulk finger wiping apparatus may be separate from or attached to the caulk cartridge. As discussed above, the caulk finger wiping apparatus may be adhesively or mechanically attached to an outer surface of a caulk cartridge. As further discussed above, the caulk finger wiping apparatus may be positioned along and at least partially surrounding an outer surface of a caulk cartridge.

The present invention is even further directed to any of the herein-described caulk finger wiping apparatus (e.g., caulk finger wiping apparatus 10) in combination with a caulk cartridge (e.g., caulk cartridge 19) and at least one caulking gun (e.g., skeleton frame-type caulking gun 22). The caulk finger wiping apparatus, caulk cartridge and at least one caulking gun may be separate from one another or combined together. For example, in some embodiments, the caulk finger wiping apparatus may be attached to an outer surface of a caulk cartridge and positioned within a caulk gun. In other embodiments, the caulk finger wiping apparatus may at least partially surround an outer surface of a caulk cartridge positioned within a caulk gun.

The present invention is also directed to kits comprising two or more of the herein-described caulk finger wiping apparatus (e.g., caulk finger wiping apparatus 10). Kits may further comprise one or more optional pieces of double-sided tape, one or more mechanical fastener pieces (e.g., pieces of adhesive-backed hook and loop material), one or more optional caulk cartridges (e.g., caulk cartridge 19), and one or more optional caulk guns (e.g., skeleton frame-type caulking gun 22).

It should be understood that the herein-described caulk finger wiping apparatus (e.g., caulk finger wiping apparatus 10) may comprise, consist essentially of, or consist of any of the herein-described components and features of the herein-described caulk finger wiping apparatus (e.g., caulk finger wiping apparatus 10). Further, combinations of the herein-described caulk finger wiping apparatus (e.g., caulk finger wiping apparatus 10) may comprise, consist essentially of, or consist of any of the herein-described caulk finger wiping apparatus (e.g., caulk finger wiping apparatus 10) in combination with any caulk cartridge (e.g., caulk cartridge 19) and/or caulking gun (e.g., skeleton frame-type caulking gun 22). In addition, any kit of the present invention may comprise, consist essentially of, or consist of any of the herein-described caulk finger wiping apparatus (e.g., caulk finger wiping apparatus 10) in combination with one or more additional kit components.

Further, it should be understood that the herein-described caulk finger wiping apparatus (e.g., caulk finger wiping apparatus 10) may comprise, consist essentially of, or consist of any of the herein-described components and features, as shown in FIGS. 2-15 with or without any features not shown in FIGS. 2-15. In other words, in some embodiments, the caulk finger wiping apparatus (e.g., caulk finger wiping apparatus 10) of the present invention does not have any additional features other than those shown in FIGS. 2-15, and such additional features, not shown in FIGS. 2-15, are specifically excluded from the caulk finger wiping apparatus (e.g., caulk finger wiping apparatus 10).

The present invention is even further directed to methods of making a caulk finger wiping apparatus (e.g., caulk finger wiping apparatus 10). In one exemplary embodiment, the method of making a caulk finger wiping apparatus comprises forming a caulk cartridge contact member (e.g., caulk cartridge contact member 23) comprising a central region having a first outer edge, a second outer edge opposite the first outer edge, a concave lower surface extending between the first and second outer edges, and a convex upper surface opposite the concave lower surface; a first side wall extending upward from and along the first outer edge of the central region, the first side wall comprising at least one cut-out portion positioned along an upper edge of the first side wall, at least a portion of the upper edge of the first side wall being above the convex upper surface of the central region; and a second side wall extending upward from and along the second outer edge of the central region, at least a portion of an upper edge of the second side wall being above the convex upper surface of the central region. The method of making a caulk finger wiping apparatus may further comprise providing a connection member operatively adapted to position the caulk cartridge contact member along an outer surface of a caulk cartridge (e.g., connection member 60).

In some embodiments, the step of forming a caulk cartridge contact member (e.g., caulk cartridge contact member 23) may comprise a single thermoforming step (e.g., an injection molding step). In other embodiments, the step of forming a caulk cartridge contact member may comprise two or more steps, wherein the two or more steps include, but are not limited to, one or more sheet forming steps (e.g., a sheet metal or polymer film forming step), one or more cutting steps, one or more thermoforming steps, etc.

As shown in FIGS. 2-15, caulk cartridge contact member 23 of caulk finger wiping apparatus 10 may be formed so as to have a three-dimensional shape. As shown in FIGS. 2-15, caulk cartridge contact member 23 of caulk finger wiping apparatus 10 may have a "modified w-shaped"; however, it should be understood that caulk cartridge contact member 23 of caulk finger wiping apparatus 10 may have any desired shape, such as a "u-shape" or any other three-dimensional shape. Further, regardless of shape, caulk cartridge contact member 23 of caulk finger wiping apparatus 10 may further comprise open ends (e.g., as shown in FIGS. 2-15, i.e., there are no side walls extending from edge 16 to edge 30 connecting first side wall 14 with second side wall 18), or enclosed ends (e.g., an embodiment, not shown, wherein side walls, of some height, extend from edge 16 to edge 30 connecting first side wall 14 with second side wall 18).

Caulk cartridge contact member 23 of caulk finger wiping apparatus 10 may be formed from a variety of materials. Typically, caulk cartridge contact member 23 of caulk finger wiping apparatus 10 comprises plastic, metal, paper, an appropriate composite material (e.g., fiber-reinforced polymer), or any combination thereof, so as to desirably form a three-dimensional shape that maintains its shape while allowing some flexibility and resilience. In one desired embodiment, caulk cartridge contact member 23 of caulk finger wiping apparatus 10 is formed from a thermoplastic polymeric material (e.g., polyethylene).

In some embodiments, the step of providing a connection member (e.g., connection member 60) may comprise one or more steps, wherein the two or more steps include, but are not limited to, applying an adhesive layer onto an outer surface of the caulk cartridge contact member, covering an outer surface of the adhesive layer with a removable release liner, providing a double-sided adhesive tape with the caulk finger wiping apparatus so that a user may apply the double-sided adhesive tape onto a desired location of the caulk cartridge contact member, providing adhesive-backed hook and loop material pieces with the caulk finger wiping apparatus so that a user may apply the adhesive-backed hook and loop material pieces onto a desired location of the caulk cartridge contact member and the caulk cartridge, attaching a male (or female) mechanical fastener to an outer surface of the caulk cartridge contact member, attaching a female (or male) mechanical fastener to an outer surface of the caulk cartridge, covering an outer surface of the adhesive layer with a removable release liner, providing a double-sided adhesive tape with the caulk finger wiping apparatus so that a user may apply the double-sided adhesive tape onto a desired location of the caulk cartridge contact member, forming an integrally connected female (or male) mechanical fastener (i.e., integrally connected to the second side wall or the concave lower surface of the caulk cartridge contact member) during the step of forming the caulk cartridge contact member, forming an integrally connected circumferencing extension member (i.e., integrally connected to the second side wall of the caulk cartridge contact member) during the step of forming the caulk cartridge contact member, etc.

It should be understood that there are no limitations with regard to how a given caulk finger wiping apparatus (e.g., caulk finger wiping apparatus 10) is made and/or combined with a caulk cartridge (e.g., caulk cartridge 19). For example, although not shown in the figures, one method of making a caulk finger wiping apparatus may comprise forming a caulk finger wiping apparatus that is integrally connected to a caulk cartridge. In this method, packaging for the caulk cartridge or the outer surface of the caulk cartridge itself may comprise a fold-out and or punched-out caulk finger wiping apparatus integrally connected thereto. The caulk finger wiping apparatus may be partially disconnected from the packaging or caulk cartridge itself, but not completely disconnected, and shaped, if necessary, the form a caulk finger wiping apparatus extending from an outer surface of the caulk cartridge (e.g., as shown in FIGS. 3-4). In this embodiment, the connection member (e.g., connection member 60) is represented by a material connecting the caulk cartridge contact member (e.g., caulk cartridge contact member 23) of the caulk finger wiping apparatus to the packaging or caulk cartridge.

The present invention is even further directed to methods of using a caulk finger wiping apparatus (e.g., caulk finger wiping apparatus 10). In one exemplary embodiment, the method of using a caulk finger wiping apparatus comprises attaching a caulk finger wiping apparatus to a caulk cartridge (e.g., caulk cartridge 19), wherein the caulk finger wiping apparatus comprises (I) a caulk cartridge contact member (e.g., caulk cartridge contact member 23) comprising a central region having a first outer edge, a second outer edge opposite the first outer edge, a concave lower surface extending between the first and second outer edges, and a convex upper surface opposite the concave lower surface; a first side wall extending upward from and along the first outer edge of the central region, the first side wall comprising at least one cut-out portion positioned along an upper edge of the first side wall, at least a portion of the upper edge of the first side wall being above the convex upper surface of the central region;

and a second side wall extending upward from and along the second outer edge of the central region, at least a portion of an upper edge of the second side wall being above the convex upper surface of the central region; and (II) a connection member (e.g., connection member 60) operatively adapted to position the caulk cartridge contact member along an outer surface of a caulk cartridge.

In some embodiments, the method of using a caulk finger wiping apparatus (e.g., caulk finger wiping apparatus 10) comprises an attaching step, wherein the attaching step comprises adhesively attaching the caulk cartridge contact member (e.g., caulk cartridge contact member 23) along an outer surface of a caulk cartridge. In other embodiments, the method of using a caulk finger wiping apparatus comprises an attaching step, wherein the attaching step comprises positioning a circumferencing extension member (e.g., circumferencing extension member 11) of the caulk finger wiping apparatus so as to at least partially surround the caulk cartridge, in some cases, completely surround the caulk cartridge.

The disclosed methods of using a caulk finger wiping apparatus (e.g., caulk finger wiping apparatus 10) may further comprise one or more additional steps. Suitable additional steps may include any one or any combination of steps including, but not limited to, positioning a caulk cartridge (e.g., caulk cartridge 19) within a caulking gun (e.g., conventional cradle-type caulking gun 21, a skeleton frame-type caulking gun 22, or a light-weight type caulking gun 40); positioning a caulk finger wiping apparatus/caulk cartridge combination within a caulking gun; applying caulk onto a surface; wiping caulk from a user's finger and/or a user's tool (e.g., putty knife, etc.) onto at least one cut-out portion positioned along an upper edge of a first side wall of the caulk finger wiping apparatus; removing the caulk finger wiping apparatus from the caulk cartridge; and re-applying a used caulk finger wiping apparatus onto another caulk cartridge.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A caulk finger wiping apparatus comprising:

a caulk cartridge contact member comprising:

a central region having a first outer edge, a second outer edge opposite said first outer edge, a concave lower surface extending between said first and second outer edges, and a convex upper surface opposite said concave lower surface, a first side wall extending upward from and along said first outer edge of said central region, said first side wall optionally comprising at least one cut-out portion positioned along an upper edge of said first side wall, at least a portion of said upper edge of said first side wall being above said convex upper surface of said central region, and a second side wall extending upward from and along said second outer edge of said central region, at least a portion of an upper edge of said second side wall being above said convex upper surface of said central region; and a connection member operatively adapted to position said caulk cartridge contact member along an outer surface of a caulk cartridge.

2. The caulk finger wiping apparatus of claim 1, wherein said connection member comprises a layer of adhesive, said layer of adhesive being operatively adapted to attach said caulk cartridge contact member along an outer surface of a caulk cartridge.

3. The caulk finger wiping apparatus of claim 2, wherein said connection member comprises a piece of double-sided adhesive tape.

4. The caulk finger wiping apparatus of claim 3, wherein said connection member further comprises a release liner positioned over an outer adhesive surface of said double-sided adhesive tape.

5. The caulk finger wiping apparatus of claim 4, wherein said connection member is positioned along a lower surface of said second side wall.

6. The caulk finger wiping apparatus of claim 5, wherein said caulk cartridge contact member further comprises a vertical element extending upward from an intermediate edge of said second side wall, said vertical element providing a stop for said caulk finger wiping apparatus when attached to a caulk cartridge positioned within a caulk gun.

7. The caulk finger wiping apparatus of claim 4, wherein said connection member is positioned along said concave lower surface of said central region.

8. The caulk finger wiping apparatus of claim 1, wherein said connection member comprises a circumferencing extension member integrally connected to said second side wall, said circumferencing extension member having a first connecting end extending along at least a portion of said second side wall, a second end opposite said first connecting end, and a curved section extending between said first connecting end and said second end, said curved section having a concave inner surface and a convex outer surface, and said curved section being sized to at least partially contact and extend along an outer surface of a caulk cartridge when positioned next to the outer surface of a caulk cartridge.

9. The caulk finger wiping apparatus of claim 8, wherein said circumferencing extension member is integrally connected to said second side wall along said upper edge of said second side wall.

10. The caulk finger wiping apparatus of claim 9, wherein said circumferencing extension member has an arc of curvature of greater than about 90° and less than about 270°.

11. The caulk finger wiping apparatus of claim 10, wherein said circumferencing extension member has an arc of curvature of about 180°.

12. The caulk finger wiping apparatus of claim 9, wherein said circumferencing extension member has an arc of curvature of greater than about 270° up to about 360°.

13. The caulk finger wiping apparatus of claim 9, wherein said circumferencing extension member further comprises a vertical element extending outward from said convex outer surface, said vertical element providing a stop for said caulk finger wiping apparatus when said circumferencing extension member of said caulk finger wiping apparatus is positioned along a caulk cartridge positioned within a caulk gun.

14. The caulk finger wiping apparatus of claim 2 attached to an outer surface of a caulk cartridge.

15. The caulk finger wiping apparatus of claim 2 attached to an outer surface of a caulk cartridge positioned within a caulk gun.

16. A kit comprising two or more caulk finger wiping apparatus of claim 1, one or more optional pieces of double-sided tape, one or more optional caulk cartridges, and one or more optional caulk guns.

17. A method of caulking, said method comprising:

combining the caulk finger wiping apparatus of claim 1 with a caulk cartridge to form a caulk finger wiping apparatus/caulk cartridge combination; and positioning the caulk finger wiping apparatus/caulk cartridge combination within a caulk gun.

18. A method of caulking, said method comprising:

positioning a caulk cartridge within a caulk gun; and attaching the caulk finger wiping apparatus of claim 1 to an outer surface of the caulk cartridge.

19. The caulk finger wiping apparatus of claim 1, wherein said first side wall comprising at least one cut-out portion positioned along an upper edge of said first side wall.

20. The caulk finger wiping apparatus of claim 19, wherein said first side wall comprising two cut-out portions positioned along an upper edge of said first side wall.

* * * * *